United States Patent [19]

Bridgeman et al.

[11] Patent Number: 5,033,744

[45] Date of Patent: Jul. 23, 1991

[54] CARD PLAYING APPARATUS WITH SINGLE CARD DISCARD FEATURE

[76] Inventors: James L. Bridgeman; Nancy L. Bridgeman; Robert J. Bridgeman, all of 9582 Hamilton Ave., Huntington Beach, Calif. 92646

[21] Appl. No.: 477,626

[22] Filed: Feb. 9, 1990

[51] Int. Cl.[5] ..... A63F 9/00; A63F 1/00

[52] U.S. Cl. ..... 273/85 CP; 273/138 A; 364/412

[58] Field of Search ..... 273/85 CP, 85 G, 138 R, 273/138 A, 143 R, 1 E, 292; 364/410, 411, 412

[56] References Cited

U.S. PATENT DOCUMENTS

| | | | |
|---|---|---|---|
| 3,735,982 | 5/1973 | Gerfin | 273/1 E |
| 3,889,956 | 6/1975 | Castle | 273/1 E |
| 4,760,527 | 7/1988 | Sidley | 364/412 |
| 4,926,327 | 5/1990 | Sidley | 364/412 |

*Primary Examiner*—Edward M. Coven
*Assistant Examiner*—Jessica J. Harrison

[57] ABSTRACT

Invention is a video draw poker game machine (FIG. 1) that includes a microprocessor (FIG. 2). It also has RAM and ROM memory for storage of programs and data (FIG. 3). The player zaps (removes and replaces) one card before the next action (FIGS. 4 and 6). To insure fast play, guiding symbols (FIGS. 5 and 7) lead a player through the game. Our invention lets the player see the new replacement card resulting from the last zap before player takes another action. Thus, the player meets more of a challenge. Casinos require fast and easy play. To speed play, displayed data packages such as guiding symbols and summary hand information aid the player. Also, play ends when winnings cannot improve (instant end), and certain hands lead to instant wins (FIG. 8). This leads to fast play and the player enjoys the game more.

19 Claims, 8 Drawing Sheets

CARD PLAYING APPARATUS WITH SINGLE CARD DISCARD FEATURE

BACKGROUND—FIELD OF INVENTION

This invention is a new poker game, in particular an electronically-simulated poker game played on electronic game machines.

DESCRIPTION OF PRIOR ART

Many versions of video draw poker have been around for over ten years. Essentially, all electronic versions play as follows: Deal five cards faceup to the player. The player selects which cards he or she likes, and discards the rest. To help this selection, there are five "hold/cancel" buttons, one directly underneath each card. The player selects a card to keep by pressing the hold/cancel button. If for some reason the player wants to change the card selection, he or she presses the hold/cancel button again. The player selects from zero to a maximum of five cards. The word 'hold' is written on the video screen above each selected card. The player discards the cards not on hold by pressing a draw button. New randomly selected cards replace the discarded cards. After the player discards, certain final hands result in money wins or credit accruals. Posted pay schedules determine the amount of player wins.

Since the video draw poker game is so limited in scope, it is classified as a slot machine.

Manufacturers and casinos have been diligently looking for new and better versions of video draw poker for some time. Some changes tried follow. They added jokers and wild cards to the card deck to stimulate play. Some versions allowed players to play double-or-nothing after a winning hand. A recent new "Second Chance" game, from Bally Manufacturing, let the player make another bet after the original round concluded. The player got one additional (sixth) card with a second chance to win. Other than jokers and wild cards and display improvements, changes have centered mainly on play after the initial round is over.

OBJECTS AND ADVANTAGES

Accordingly, we have provided a video poker game with the following objects and advantages.

Our video zap poker game changes the pattern of removing and replacing cards through a new 'zap' action. It provides an exciting new way to play. It affects the game throughout the play of a round, and not after the round is over.

Our invention gives the player multiple chances for better hands. The deal action in the preferred embodiment displays five cards faceup. Other embodiments may have more displayed cards, while others have less displayed cards. Five cards remain faceup throughout the round. The player zaps (removes and replaces) any card one-at-a-time. The player can freeze the round at any time with a freeze action. With a winning hand, a freeze action leads to a win, and winnings. After the maximum number of zaps, the round ends automatically.

Also, an instant end is employed, ending the round when there is no hope of improving a money or credit win with more zaps. Now, no draw poker game ends a round in a similar way.

No other draw poker game allows for instant wins when certain combinations of cards appear. We do not make the player push buttons when a Royal Flush appears as before. Also, other specified winning combination of cards declare an automatic win (instant win). This improves the speed of play considerably.

By pressing the deal button, the player deals five cards faceup (preferred embodiment) from the shuffled and cut card deck. Corresponding to each of the cards displayed on the video screen is a "ZAP" button. Each ZAP button lines up with the associated displayed card. The player zaps a card by pressing the associated ZAP button. This causes the immediate removal of the associated card. A randomly selected replacement card from the shuffled and cut card deck promptly takes the place of the zapped card. The player can take no other actions until the replacement card shows on the screen. With the display of the new card, the player can intelligently determine the next action to take. Game strategy can be employed by the player.

In all variations of the present game, there is a two step discard operation. First, the player selects zero to five cards to hold by pressing hold buttons for associated cards. The player holds the maximum of five cards by pressing HOLD buttons five times. Next, the player presses the DRAW button to discard the non-hold cards. Our game is a one step discard operation with a ZAP button.

The second action above (draw) does not appear in our invention. Our game immediately removes the original card when the player presses the ZAP button. A new randomly selected replacement card takes the displayed position of the removed card. No other action is possible until the zap action finishes. Then the player zaps another card. This continues one-at-a-time until the round is over.

In the basic game, the player has one, and only one, chance to make a winning hand making it basically a slot machine. Our game is a real game giving the player multiple chances to win.

Our invention answers the search for a new way to play video poker without causing the payoff schedules to change during play. The "second chance" phase of the Bally game reduces the payoff schedules from the original chance. The odds change because the extra sixth card helps make a better five card hand. Players expect the royal flush payoff (maximum payoff) to be the same regardless of the changed odds, and this causes confusion. The payoff schedule in our game does not change during play of the round.

To play for a royal flush, the player holds all cards having the same suit with a number equal to ten or more. Then the player discards the other cards. With our one-at-a-time game, a player zaps one card. If the replacement card helps the hand toward a royal flush, the player keeps trying for a royal flush. Otherwise, the player tries for a different hand with a lower payoff. After initially going for a royal flush, the player will get wins missed in the current draw poker game. Our game is a real game where the player can develop game strategies to go for a straight, flush, three of a kind, etc. Our zap poker is a game of skill and not a slot machine.

One-at-a-time zap poker guiding symbols lead the player smoothly through the round. Present draw poker video machines do not help the player make discard decisions. Our invention places simple graphic symbols above the cards. They tell the player to keep certain cards, and to zap others. Guiding symbols let the player zap one card after another without spending much time examining the hand.

The preferred embodiment of our game is maximum of five zaps per round and only one zap allowed per card position. Game design allows other embodiments. For instance, the maximum number of zaps per round is a game design parameter. Another game design parameter is the maximum number of zaps per card position. A one-at-a-time zap poker game is possible with twenty zaps per round, and four zaps per card position. With this much flexibility, discretion is advisable in selecting ones preferred embodiment.

Further objects and advantages of our invention will become apparent from a consideration of the drawings and ensuing description of it.

SUMMARY

We have a new poker game where cards are replaced one-at-a-time. The player sees the replacement card before one has to select the next card. We have a new "zap" action which removes and replaces each card one-at-a-time. We display a guiding symbol above each card to aid the player making zap decisions. We have an instant win feature ending rounds for certain types of hands. We also have an instant end feature which ends rounds where winnings cannot improve, or where the hand is an obvious loser.

DRAWING FIGURES

DRAWING REFERENCE NUMERALS

Figure 1:
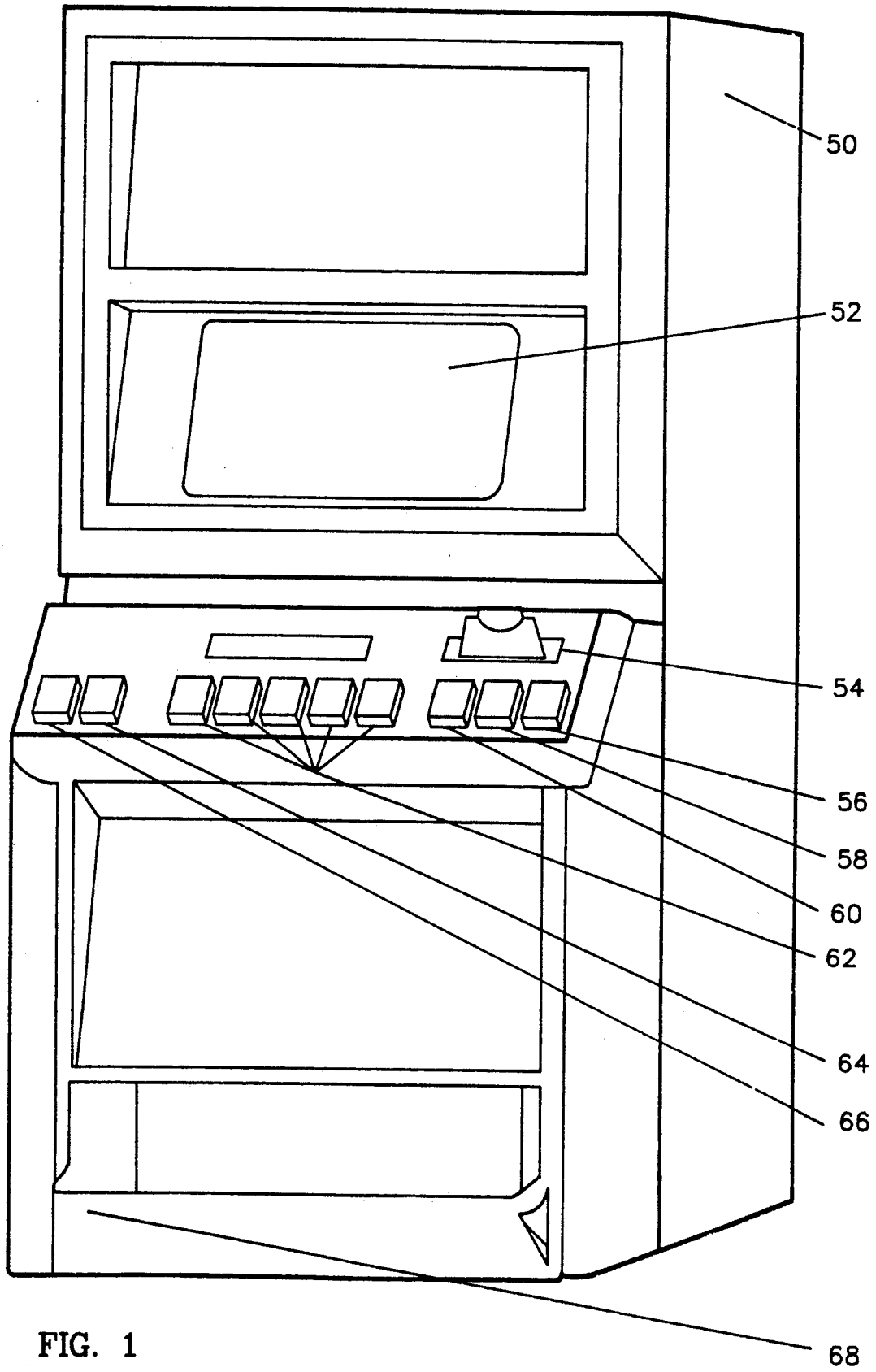
FIG. 1 is a perspective view of an electronic video zap poker game machine according to the present invention.

50 cabinet of video zap poker game machine.
52 Cathode ray tube (CRT).
54 coin/credit inlet.
56 BET button.
58 DEAL button.
60 FREEZE button.
62 ZAP buttons.
64 game REPLAY button.
66 COLLECT button.
68 coin/credit outlet.
200 central processing unit (CPU) to execute instructions.
202 read only memory (ROM) to store permanent data.
204 random access memory (RAM) to store volatile data.
206 cathode ray tube controller.
208 circuit to refresh memory 200.
210 read only memory of 206.
212 video circuit for displays.
214 cathode ray tube.
216 clock circuit.
218 input/output port for 236, 238, 240.
220 input/output port for 242.
222 input/output port for 244.
224 input buffer for buttons or keys 236.
226 drive circuit for 238, 240.
228 buffer for coin or credit acceptor 242.
230 drive circuit for 242.
232 buffer for disk drive 244.
234 drive circuit for 244.
236 key activators or buttons.
238 light circuit.
240 sound generator.
242 coin or credit.
244 disk drive, permanent storage device.

DETAILED DESCRIPTION—FIG. 1

FIG. 1 shows a perspective view of a video zap poker game machine according to our invention. This machine displays cards and other symbols, services button actions, collects bets and makes payoffs in the form of credits, points or coins.

The machine's cabinet is about 100 cm high, 45 cm wide, and 45 cm deep. It includes a cathode ray tube 52 or like display panel hardware.

The player inserts the proper number of coin(s) in a coin/credit inlet 54 to begin playing the game. The coin inlet connects to a coin hopper (which includes a coin/-credit outlet 68) which stores coins and disperses payoffs to winners.

The player sets the bet amount by pushing BET button 56. After setting the bet size once, it remains the same for later rounds until the player changes it. In the preferred embodiment, the player deals five cards (original cards) faceup by pushing a DEAL button 58. The player then "zaps" (removes and replaces) an original card by pressing a ZAP button 62. A randomly selected new replacement card replaces the original card before the next player action. The preferred embodiment allows the zapping of original cards only. Other embodiments allow the zapping of replacement cards also.

The player can end the game at any time by pushing a FREEZE button 60. During play, a "freeze to win X" display message may appear. The "X" represents a number. This tells the player that the hand is a winner and wins X units (coins or credits) if the player ends play now. If the player pushes FREEZE button 60, the game ends and the player receives the win.

Once the player has zapped the maximum number of allowed zaps, the round is over. When the player wins, the win amount adds to the credits, with the credits display updated. The player collects credit winnings by pushing a COLLECT button 66. The credits convert to winnings as coins dropped in the tray of coin/credit outlet 68. A REPLAY button 64 replays any disputed poker round. If necessary, REPLAY button 64 can be located inside cabinet 50 to keep the player from accessing it.

All buttons or keys necessary to play the zap poker game are on the front surface of cabinet 50 (FIG. 1). There are five ZAP buttons (preferred embodiment), one for each displayed card position. Each ZAP button is located directly under the associated card position. This makes it convenient for the player to zap the proper card.

BET button 56 may not see much action after setting the bet size. It remains the same for all rounds until the player changes the bet size again. The player only has to deal and zap cards during a round. The bet automatically advances at the start of each round. It comes from available credits for the amount of the bet size. If there are not enough credits for the bet size, the "Insert Coins" message appears to prompt the player. The player either inserts coins, or changes the bet size.

Buttons DEAL 58 and FREEZE 60 are next to each other for easy access. It is possible to combine the deal and freeze buttons into one "DEAL/FREEZE" button if desired. This is possible because the DEAL button only starts a round, and the FREEZE button only ends a round. Thus, they serve mutually exclusive functions and do not interfere with each other. Therefore, one button can do the job of two.

Besides keys, other player input controllers are available. Examples include a mouse, a computer keyboard, a joystick, a touch screen, and a light pen.

DETAILED DESCRIPTION—FIG. 2

Figure 2:
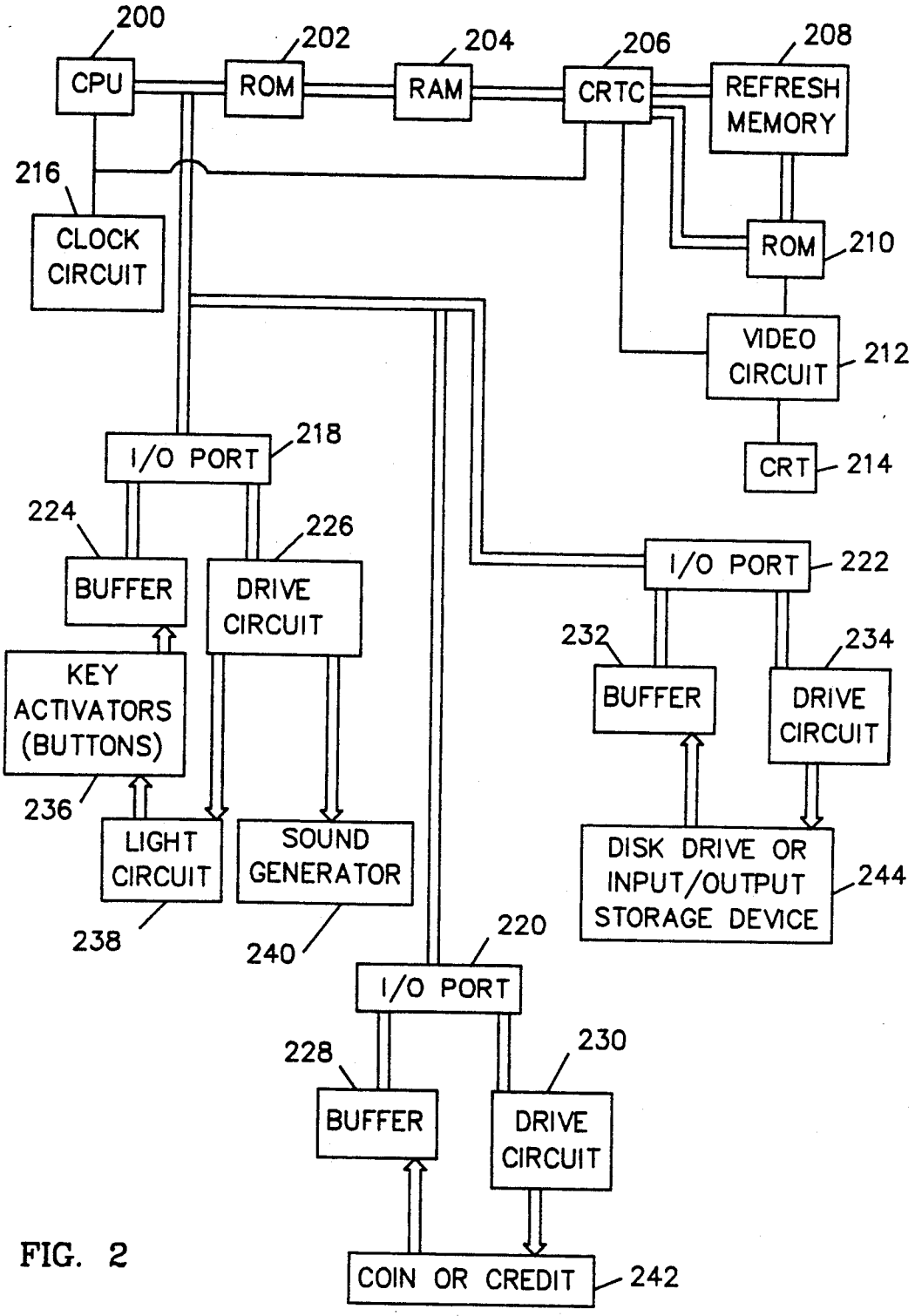
FIG. 2 is a circuit block diagram of the video zap poker game machine of FIG. 1.

FIG. 2 shows a block diagram of a circuit for our video zap poker game machine as shown in FIG. 1.

A CPU (Central Processing Unit) 200 executes various operations and does processing while accessing memory locations in RAM (Random Access Memory) 204. The program transfers from ROM (Read Only Memory) 202 to operate in RAM 204. Other possible storage devices include: static memory, magnetic disks, magnetic tapes, paper tape, and laser storage. A battery backed up RAM 204 keeps the game variables stored if power goes down.

ROM 202 and RAM 204 make up the memory storage area. RAM is alterable during the operation of the poker game, and can be written over. "Read And Write Memory" is a more descriptive term for RAM. ROM is also a random access memory, but it is not erasable, and cannot be written on. Turning off the power supply does not affect ROM.

CPU 200 controls the input/output of an I/O port 218 which includes key activators or buttons 236. They control the buttons for actions such as bet, zap, freeze, deal, collect, etc.

CPU 200 also executes input/output operations through I/O port 222 to a buffer 232 and a drive circuit 234 for permanent mechanical storage devices such as a magnetic disk, magnetic tape, and cartridges 244.

CPU 200 controls the coin operation or credit setting device 242 that is mechanical or electronic or both, through I/O port 220 by means of a buffer 228 and a drive circuit 230. The coin operation is crucial to operating a video poker machine. The coin hopper must be able to store coins and be able to make payoffs in the correct amount. Some gambling jurisdictions require paper ticket printers instead of coin hoppers. This a simple change.

A zap poker program in ROM 202, or RAM 204, operating under CPU 200, clears and restores memory 208 A CRT Controller 206 reads out the image pattern (memory bit map) for a card from ROM 202 into RAM 204. It converts this data in parallel format to serial data format, and sends it to video circuit 212. A predetermined image appears on CRT 214, based on the video signals generated.

Various sequences require close timing during the operation of the game. One message may show for three seconds, another for five seconds, etc. A clock circuit 216 sends out clock signals to control the timings of CPU 200, and CRT Controller 206. Also, a buffer 224 holds instruction activator/key 236 input information. A drive circuit 226 controls the light circuits 238 that light up the buttons to indicate the key activators 236 are ready to accept input data.

A sound generator 240 signals the player to acknowledge the pressing of a key, or that a win has occurred. Each bonus win has different patterns of melody and each has different lengths of time played.

Drive circuit 230 drives a coin/credit detection device 242 to execute a credit detection, lock out and coin release operation. Also, a buffer 232 holds the input from a memory storage device, such as a disk drive 244. CPU 200 directs the flow of data into RAM 204. A drive circuit 234 drives a memory storage device 244 to execute reads/writes for data and statistics. These statistics show on the screen or are sent to hardcopy devices 244. Statistics include data such as amount of winnings, available credits, summary hand information and other game information.

Many details do not appear in the above hardware description. To one skilled in the art, these omitted details are obvious. Hardware for the zap poker game machine is similar to existing machines. The coin hoppers are standard equipment, as are IBM computers, monitors, and VGA cards. It is relatively simple for an experienced engineer in the gaming business to construct a comparable machine.

DETAILED DESCRIPTION—FIG. 3

Figure 3:
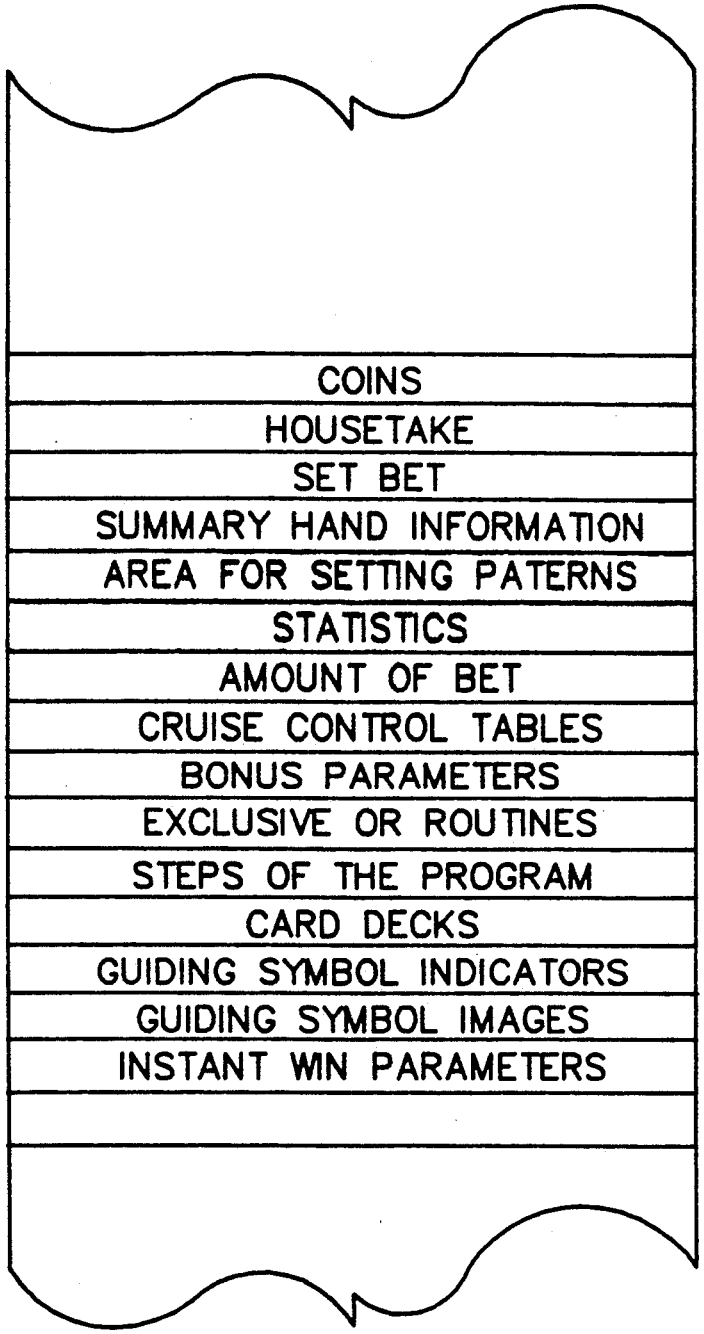
FIG. 3 shows a memory allocation for a data storage and retrieval area used by our video zap poker game machine of FIG. 1.

FIG. 3 illustrates the various programs kept in ROM or RAM storage for retrieval and interrogation. See the memory allocation in FIG. 2 at 202, 210, and 204.

During the operating of the game, there are many questions that need answering, such as the following examples. What is the bet size? How many zaps have occurred? Are there enough credits?

The CPU records in RAM the responses to these questions. The game program, operating in ROM and RAM, interprets the responses, and acts according to predetermined logic.

FLOW CHARTS FOR FIGS. 4 TO 8

The following flow charts for FIGS. 4 to 8 outline the operating steps of the one-at-a-time zap poker program. The operation of the game is discussed from the perspective of a player (relative to FIG. 1).

FLOW CHART FOR ONE-AT-A-TIME ZAP POKER—FIG. 4

Figure 4:
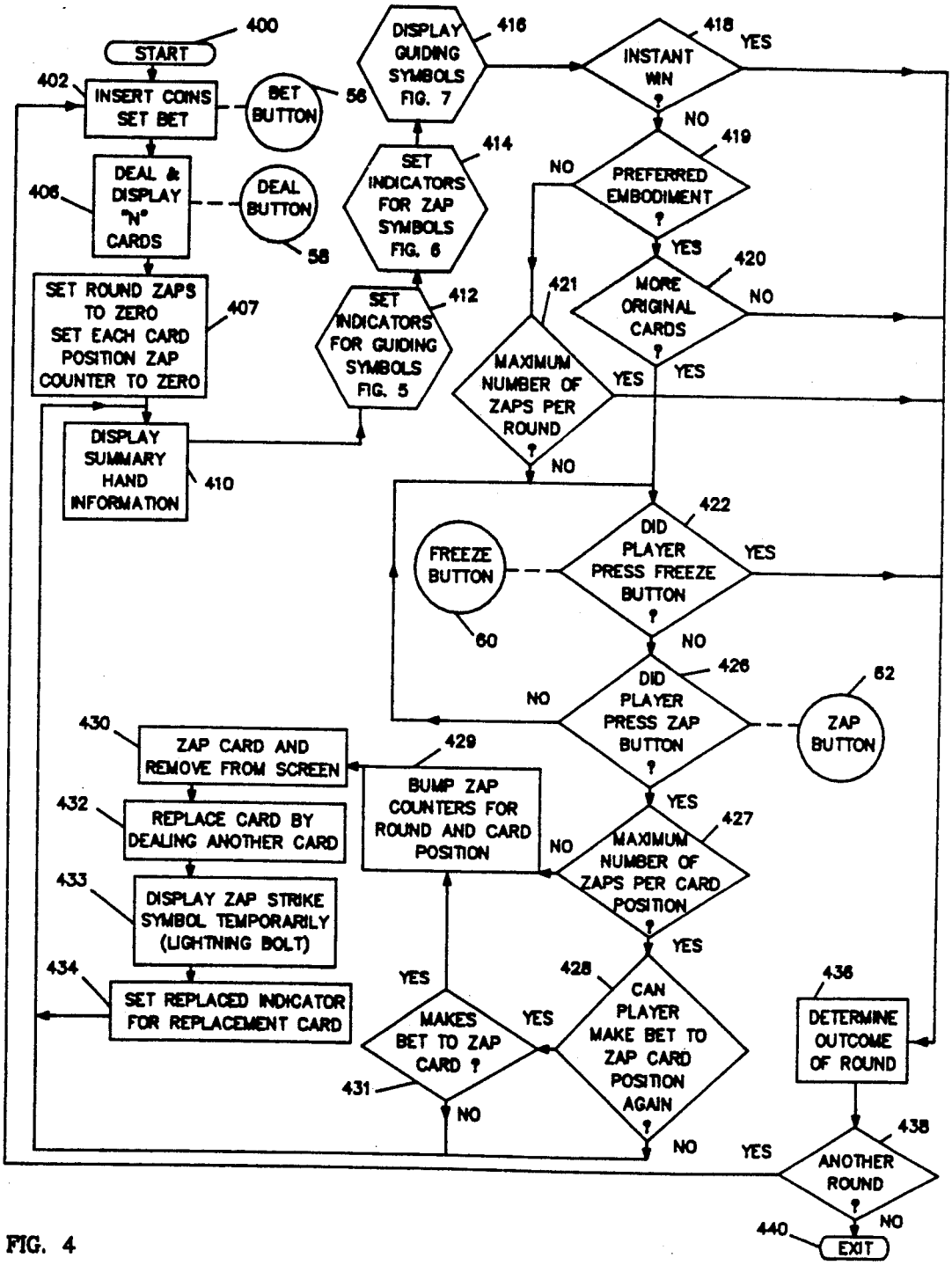
FIG. 4 is a flow chart for our one-at-a-time zap poker game machine of FIG. 1.

FIG. 4 is a flow chart for our video zap poker game. It introduces the zap action, where it removes a card and replaces it with a replacement card in one action. In our preferred game embodiment, the maximum number of zap actions per round is five with one zap per card position. That is, the maximum number of zaps equals the number of original cards after the deal. Every previous video draw poker game has only one discard action per round. Other embodiments have more or less than five cards.

For the casino market, fast play is essential. For this reason, we added several displays to speed play. We display a guiding symbol, when appropriate, above each card showing a course of action for the player. It suggests whether to zap or to keep the card, and why.

Information about the player's hand is found in the summary hand message block. It gives the handtype and handrank, and tells of possible straights and possible flushes. From these displays, the player can decide faster. However, play must also end when the hand cannot improve winnings, or when the hand is a definite loser. This is done to keep play moving along at a fast pace. Further, instant wins for certain handtypes and handranks speed play. If the hand passes a threshold test, the machine declares the winnings and ends the game.

A zap action removes a card from the display and replaces it immediately. The player sees each new replacement card before the next zap action. Since more information is available to the player, stimulating play results. New guiding symbol displays lead the player through the game, resulting in faster play.

The process starts (step 400) for one-at-a-time zap poker. The player deposits coins into the video poker machine. Then the player enters the bet size (step 402) to the desired amount by pushing BET button 56.

Deal "N" cards (step 406) by pushing DEAL button 58. "N" is the number of cards dealt whether it is more or less than five. Call each of these cards an "original card" throughout the specification. Call any card a "replacement card" which is other than an original card.

In step 407, set the round zaps counter to zero and set each card position zap counter to zero. This prepares parameters for tracking zaps per round and by card position. In the preferred embodiment there are a maximum of five zaps a round, and one zap per card position during a round. Other embodiments may allow more, some less. The game keeps the count of zaps for each card position during a round. This allows the game to handle more than one zap per card position.

Some embodiments allow a bet for each zap. If so, the machine clears a zero-zaps counter for each card position. This counter tells how many bets have been made for a card position. There is a maximum zero parameter which limits the maximum number of bets allowed to zap each card position. The zero zaps counter will be bumped for a card position each time a bet is made to zap that card position.

Another embodiment allows player to a zap every card position after making a bet. That is, every card position can be zapped a maximum of one time after a bet. For this embodiment, clear an all-zero counter which keeps track of the number of such bets. There is a maximum all-zero parameter used to limit the number of such bets to get more zaps for every card position. Each such bet will increase the all-zero counter.

The machine processes the hand information for "N" cards and summarizes the data for "N" cards into a summary hand information block. It displays it at step 410. Summary hand information shows 'HOUSE J/3' for a hand with a handtype of a full house, jacks-over-threes. In this example, the handtype is a full house and the handrank is jack. A hand value combines the handtype, handrank, and lesser hand ranking data. It differentiates between hands with the same handtype and same handrank. If a hand has two pairs with ranks of ten and seven, the summary hand information shows 'PAIRS 10/7'. The handtype is two pairs. The highest pair determines the handrank of ten. In this example, hand value includes handtype and handrank. However, it also includes the sevens low pair and the non-pair card not shown.

Additionally, the summary hand information includes data about possible straights and possible flushes. Say, the hand includes the following card numbers: K, 8, 6, 5, and 4. The obvious possible straight appears as '?STRAIGHT 8?'. Further, a straight guiding symbol (a question mark '?') displayed above the king tells the player to zap the king to try for a straight. Both displays show there is a possible eight high straight if one zaps the king (K).

For a possible flush discussion, consider a hand that has four clubs and one heart. The highest club is a queen and the sole heart is an ace. The summary hand information would appear as '?FLUSH Q?' to say possible flush (present high club a queen). Also, a flush guiding symbol, (an exclamation point '!') shown above the ace of hearts tells the player to zap it to try for a flush.

The machine sets the indicators for the guiding symbols (step 412). These indicators translate later into guiding symbol displays (visual clues). These guiding symbols highlight pairs, three of a kind, possible straights, possible flushes, and other data. Use the guiding symbol indicators set in step 412 to determine which card positions should have zap guiding symbol indicators set (step 414). Guiding symbols displayed directly above each of the cards show which cards to keep or which to safely zap (step 416). Not only do these symbols help the player decide correctly, they speed the game.

Now, the machine declares instant winning hands at step 418. When the handtype is the highest possible handtype, such as a royal flush, declare an instant win without player action. Don't make the player push buttons to accept it (as done before). The game design has an instant win handtype threshold parameter. Say the threshold has a handtype setting of a straight. Then instant wins declare for any hand equal to or higher than a straight. With a joker or wild card, five of kind is also an instant win. The machine goes to step 436 to determine the win amount.

If not an instant win at step 418, the machine sees if the preferred embodiment (step 419) is selected. If so, it allows five zaps per round and one zap for each card position (step 419). It sees if there are more original cards (step 420). If yes, it goes to step 422. Otherwise, it goes to step 436 and ends the round.

In other than the preferred embodiment, the machine sees if the maximum number of zaps per round has occurred. If yes, it goes to step 436. Otherwise, it goes to step 422.

The machine sees if the player pressed ZAP button 62 (step 422). If not, it repeats the steps beginning at step 422 until the player takes a freeze or zap action.

It is important for betting purposes to determine if the maximum zaps have occurred. We may want the player to pay for more zaps when the odds are increased in their favor. If the player pressed ZAP button 62, and if the maximum number of zaps for the card position was not exceeded (step 427), the machine goes to step 429.

One embodiment allows a card position to be zapped more then one time per round, while not allowing the card position to be zapped if the previous zap action was for that card position. That is, the card position can not be zapped two times in a row. See if this embodiment is in effect. If yes, and card position being zapped twice in a row, the machine goes to step 410.

Depending upon the maximum parameters set, the player may have to pay (bet) for each card, after a certain number of cards or if the same position is zapped twice. The machine sees if the player can make a bet to zap the card position again (step 428). If yes, it goes to step 431. There may be other card positions to zap (original cards in the preferred embodiment). If not, it goes to step 410.

Otherwise, it sees if the player made a bet (step 431). If not, it goes to step 410. If yes, it goes to step 429. The player took the option of making a bet for another zap of the card position.

The steps described in the above paragraph apply to embodiments of the game other than the preferred embodiment. In the preferred embodiment the machine checks only to confirm card is an original card. If so, it allows the zap. By default, the maximum number of zaps per card position is one.

At step 429, the machine bumps the zap counters for the round and for the card position. After zapping the card, it removes it from the hand and from the display (step 430). It randomly selects a replacement card from the remaining card deck and displays the replacement card in place of the removed card (step 432).

In step 433, it displays a zap strike symbol temporarily. A lightning bolt (or similar display) strikes the card when depressing ZAP button 60. This visual clue confirms the zapping of the proper card.

The machine will not allow any player action until the zap action processing finishes. It sets the replaced indicator for a replacement card (step 434) when the maximum zaps (one in preferred embodiment) per card position occurs. This later causes a display of the replaced guiding symbol. The replaced guiding symbol quickly highlights replacement cards to distinguish them from the original cards. A stop sign is an appropriate replaced guiding symbol with all actions stopped for the associated card.

In the preferred embodiment, the stop sign pops up after only one zap per card position. The stop sign is the replaced guiding symbol. Optionally, another embodiment allows each card position more than one zap. Under this option, the replaced guiding symbol displays after the last allowed zap for a card position. A stop sign prevents any more actions for that card position.

After the player receives the new replacement card, summary hand information updates. New guiding symbols reflect the new status for each card. The flow chart returns to step 410. The machine repeats all steps until there are no original cards (preferred embodiment) left, or the FREEZE button pressed.

The machine displays the round results at step 436. It shows winnings, new amount of credits gathered, and the final handtype (summary hand information).

It declares an instant win for certain handtypes and handranks. Also, it ends play immediately for hands which are obvious losers. Similarly, when the hand cannot improve through more zapping, it ends the game promptly and determines the outcome. This is important to speed play.

In step 438, it sees if player is going to play another round. The player plays again by inserting more coins, or using credits won from earlier play (step 418). The machine goes to step 402 to start another round. Otherwise, it exits (step 440).

Those skilled in the art can readily see that this new method of play for video one-at-a-time zap poker leads to several variations. The preferred embodiment allows one zap per card position. Another embodiment allows more than one zap per card position. Still another embodiment allows flexibility in the number of zaps per round. A one-zap-per-round game is possible, that is, only one zap for only one card position. Likewise a twenty-zap-per-round game is possible. One could zap one card position twenty times, two card positions ten times each, five card positions four times each, and so on. The maximum number of zaps per round is a game parameter. Another embodiment requires that the player make another bet before zapping a card position occupied by a replacement card.

Still another embodiment requires that player not zap the same card position two times in a row. This prevents a player going for the obvious royal flush, especially when there are four cards toward a royal flush showing. The player would repeatedly zap the same card position. Too many royal flushes would be the likely result. Therefore, one game design requires the zapping of different card positions on successive zaps. A variation of this embodiment allows successive zaps on the same card position if player makes another bet.

Many embodiments treat replacement cards as original cards. This allows unrestricted multiple zaps for each card position. Only game design limits the number of zaps for a card position in a round. Similarly, game design limits the total number of zaps during a round. A round could have five zaps allowed, or any number of zaps. Optionally, a player must make another bet before zapping a card position earlier zapped. One game implementation might require that different card positions be zapped in successive zap actions to prevent too easy wins.

Finally some embodiments require a bet per zap action. Some require a bet to zap all card positions. That is, another bet allows one more zap for all card positions. The number of bets allowed is limited by certain parameter settings.

FLOW CHART TO SET INDICATORS FOR GUIDING SYMBOLS—FIG. 5

Figure 5:
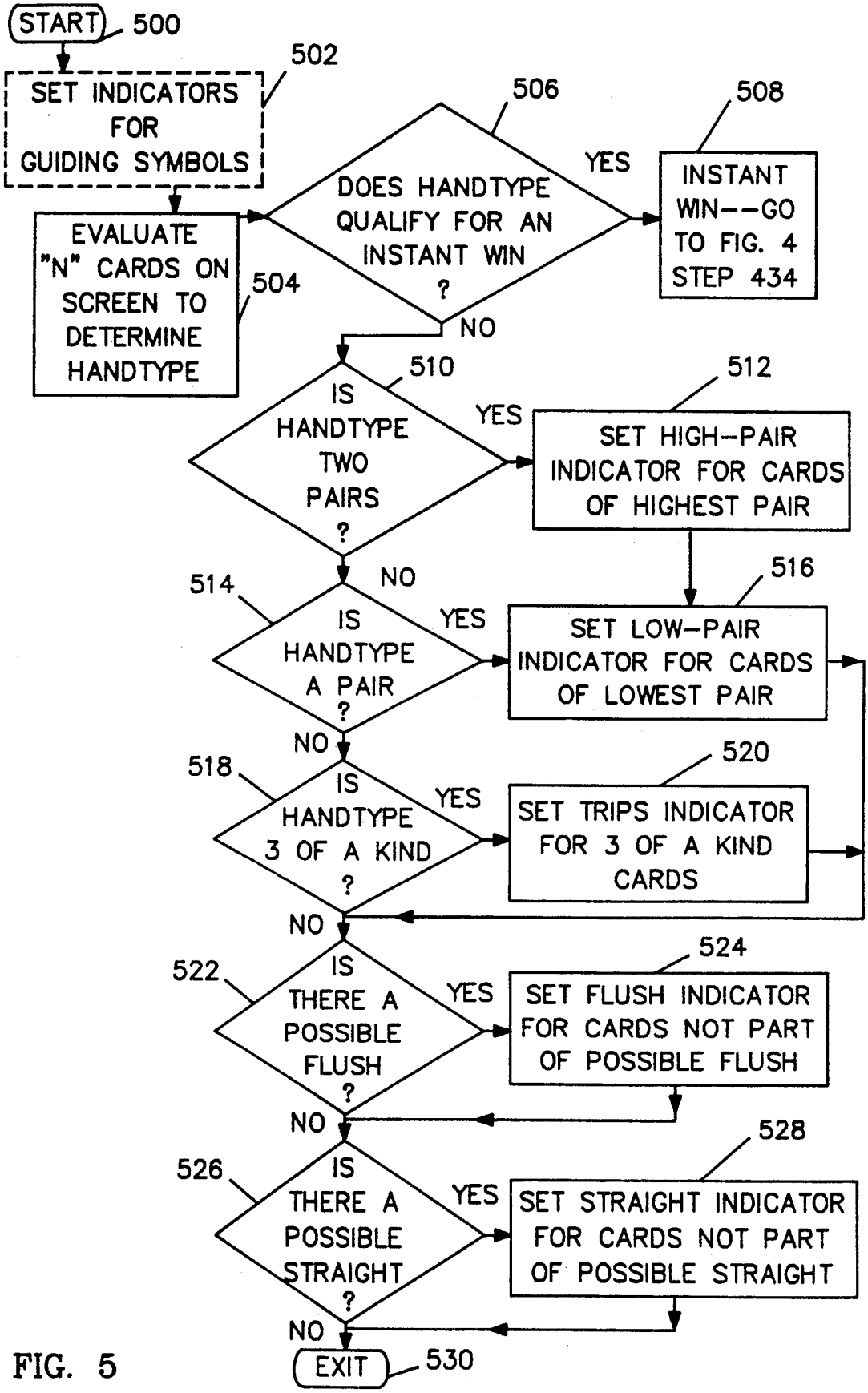
FIG. 5 is a flow chart showing how to set the indicators for guiding symbols.

FIG. 5 is a flowchart showing when to set indicators for guiding symbols other than the zap and replaced guiding symbols. The following is a discussion of the flowchart steps.

The machine starts processing (step 500) at step 502.

It deals and displays "N" cards faceup on the screen. It determines the handtype for the card hand (step 504). The handtype tells the card combinations found in the hand. Then it examines the hand and each card, to set the proper indicators for each card. These indicators will cause the later display of various guiding symbols excepting the replaced and zap guiding symbols.

First, does the handtype qualify for an instant win (step 506)? If yes, the machine declares an instant win (step 508). It goes to step 436 (FIG. 4) to determine the outcome of the game, calculate winnings, then ends play.

Second, there being no instant win, is the handtype two pairs (step 510)? If yes, the machine sets the high-pair indicator for the cards part of the highest pair (step 512). It sets the low-pair indicators for cards part of the lowest pair (step 516). Displayed symbols are different for the high pair guiding symbol and the low pair guiding symbol, if only in color. It goes to step 522.

Third, is the handtype one pair (step 514)? If yes, the machine sets the low pair indicator for the low pair cards (step 516). It goes to step 522.

Fourth, is the handtype trips, (three of kind) in step 510? If yes, the machine sets the trips indicator for cards part of the three of a kind (step 520). It goes to step 522.

Fifth, is there a chance for a flush (step 522)? If yes, the machine sets the flush indicator for the original cards not part of the possible flush (step 524).

The flush indicator causes a later display of a flush guiding symbol showing a chance to get a flush. The machine sets the indicator only for the original card with a suit different from other cards. This decreases the information displayed. Showing flush guiding symbols for cards part of a possible flush would clutter up the display and lessen the importance of the symbol.

Sixth, is there a possible straight (step 526)? If yes, the machine sets the straight indicator for the original cards not part of the possible straight (step 528). This causes a later display of the straight guiding symbol for the card to zap. Normally, it shows only one straight guiding symbol. Two straight guiding symbols show for the handtype of one pair in the following instance. The pair cards fit in the straight range of five. That is, all displayed card numbers are within five of each other. One must zap a pair card to try for the straight. By showing exception displays with this approach, clutter is lessened. Then, a straight guiding symbol means more to the player. We use the philosophy of highlighting only those cards to zap for a chance at a straight.

Seventh, all steps are complete and all the guiding symbol indicators set. Exit the program (step 530).

FLOW CHART FOR SETTING ZAP INDICATORS—FIG. 6

Figure 6:
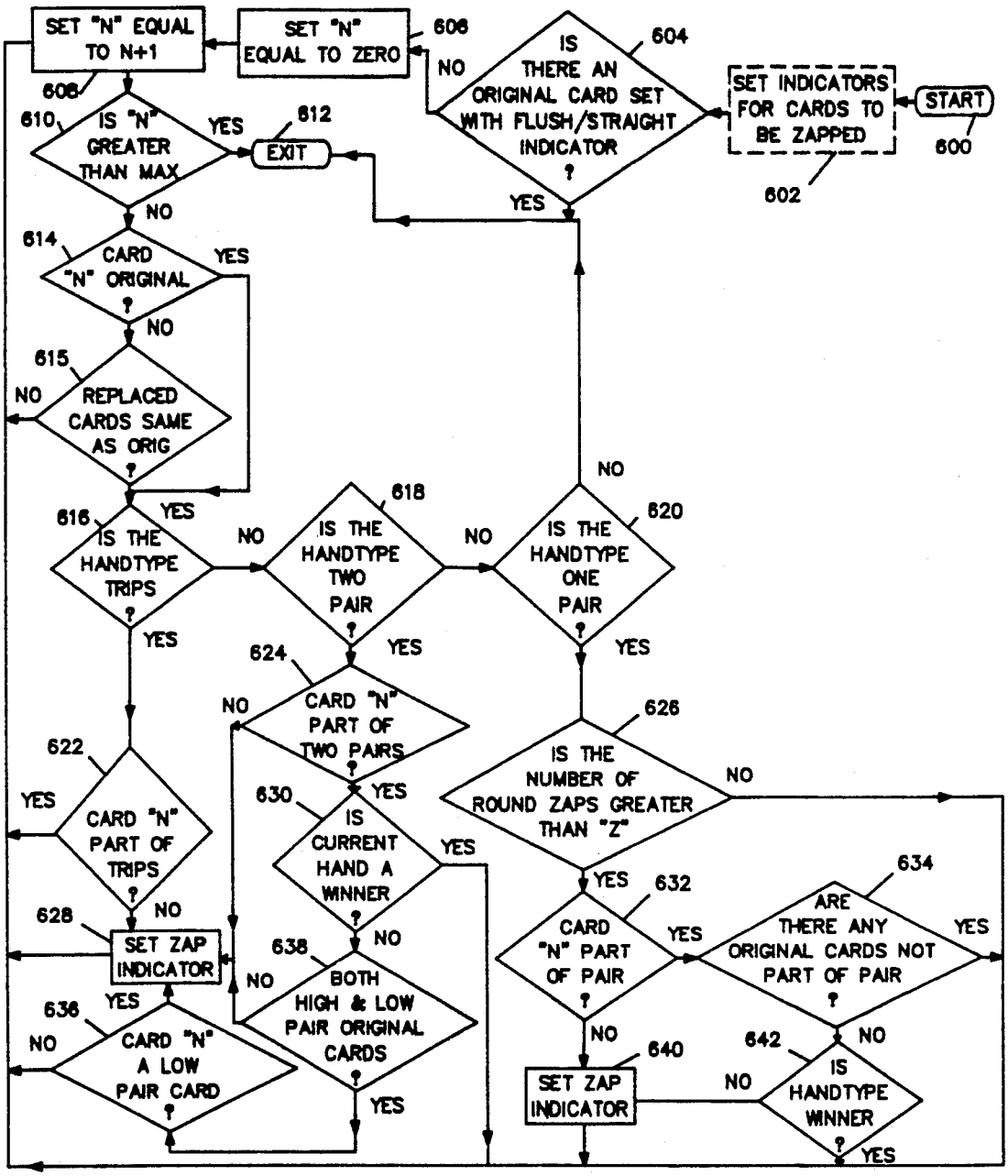
FIG. 6 is a flow chart showing how to set the zap indicators.

FIG. 6 is a flowchart showing how and when to set the zap indicators for cards. Zap indicators cause a later display of the zap guiding symbol. These symbols show the player which cards to safely zap. An ideal guiding symbol for the zap guiding symbol is the "thumbs down" image. It means the associated card adds nothing to the current hand. It tells the player to zap it.

However, the machine will not show the zap guiding symbol when other information is more valuable. When a chance exists for a flush or a straight, it displays a flush or straight guiding symbol. A "thumbs down" display over another card now gives too strong of a message. It tells the player to zap that card, rather than go for the flush or straight. Therefore, the zap guiding symbol does not appear when a straight or flush guiding symbol does.

The machine will not show a zap guiding symbol early in the game unless the handtype is better than one pair. Too many zap guiding symbols make them less valuable to the player. If the hand is better than one pair, other guiding symbols outnumber the zap guiding symbols. Therefore, the player sees one or two zap guiding symbols at most.

A two-pair hand has four pair guiding symbols showing. Two show for a high pair and two show for the low pair. It is reasonable that the fifth card is a zap candidate. A zap guiding symbol should show for the fifth card. Likewise, when a "trips" (three of a kind) occurs, three cards have a trips-guiding symbol. It is natural, then, for the fourth and fifth cards to have zap guiding symbols displayed.

Say we don't use the instant win feature where winning hands automatically end the round. Then the following handtype discussions apply. Four-of-a-kind hands require one zap guiding symbol. A full-house hand has no room for the zap guiding symbol. Trips and pair guiding symbols cover all card positions. What else is there? Straights and flushes are winning hands. It is unwise to tell the player to break up a winning hand. Certainly, a straight flush (including a royal flush) hand requires no zap guiding symbols.

The machine will not display too many zap guiding symbols. The following threshold tests keep this from happening.

First, the machine sees if the handtype is one pair or less. If yes, the machine will not show a zap guiding symbol before the number of zaps exceed a "Z" variable. The "Z" variable is a game parameter for a certain number of zaps. It tells when to start showing zap guiding symbols for pair or less hands. However, if only one original card remains, it will show the zap guiding symbol over that card regardless of the handtype. This assumes that the card has no higher priority guiding symbol indicator set.

Second, the machine sees if there are other guiding symbols with higher priority. For example, another card position has a guiding symbol for a straight or flush chance. In this case the machine won't show a zap guiding symbol.

Third, towards the end of the round, the machine increases the priority of zap guiding symbols when a pair or two pairs cannot win. The, it shows a zap guiding symbol when no non-paired original cards remain in pair hands.

The following example is for the preferred embodiment. Say all five original cards from the deal are useless. Assume there is no discernable pattern to the cards. The player would discard four or five cards in the present draw poker video game. Our invention lets the player zap one card, then look at the results before continuing. Maybe a straight chance appears where one didn't appear to exist before. The player then makes a complete turnaround in the zapping pattern. Now, there is meaning to each zap. And the player becomes intrigued over a hand that originally appeared worthless.

Start at step 600 to set the zap indicators for the cards (step 602).

A set of cards are dealt to the player. For the preferred embodiment, the first five cards dealt are original cards. Cards that take their place upon a zap action are replacement cards. Original cards and replacement cards, of course, will appear together on the screen display. We must distinguish between original cards and replacement cards for the preferred embodiment. Other embodiments treat replacement cards the same as original cards. They do, that is, until the number of zaps for a card position exceeds the maximum allowed per card position. The following discussion refers to original cards. Therefore, consider replacement cards same as original cards when playing other embodiments.

Before continuing, the machine asks the following question, "Is there an original card set with a flush or straight indicator?" (step 604). If the answer is yes, it exits (step 612). A zap symbol would detract from the more valuable flush or straight data set at FIG. 5 (steps 524 and 528).

The machine sets "N" equal to zero (step 606). At step 608, it sets "N" equal to "N"+1.

The machine sees if "N" is greater than the maximum number of cards displayed (step 610). If "N" is greater than maximum, it exits (step 612). Processing of all cards is complete. Step 614 asks if the card is an original card. If yes, go to step 616.

If not an original, the machine sees if replaced cards are treated the same as original cards (step 615). The preferred embodiment handles them differently. If not treated the same, it goes to step 608 to repeat the process.

It gets the handtype at step 616 and sees if the handtype is three of a kind (trips) at step 616.

Second, if the handtype is not trips, it sees if the handtype is two pairs (step 618).

Third, if the handtype is not two pairs, it sees if the handtype is one pair (step 620).

Fourth, in step 620, if the handtype is not at least a pair, it exits (step 612).

If the handtype in step 616 is trips, the machine sees if card "N" is part of the trips (step 622). If card "N" is part of the trips (step 622), it goes to step 608.

Otherwise, it sets the zap indicator for card "N" at step 628, then goes to step 608.

If the handtype is two pairs (step 618), it sees if the card "N" is part of the two pairs at step 624. If it is not, it sets the zap indicator for card "N" at step 628 since this card does not help the hand. By zapping it, a full house might result. Then it goes to step 608.

If card "N" is part of two pairs, the machine sees if the current hand is a winner at step 630. If the current hand is a winner, it goes to step 608. If the current hand is not a winner, it sees if there are both high and low pair original cards showing at step 638. If yes, it sees if card "N" is a low pair card (step 636). If not (step 636), it goes to step 608. Otherwise, it sets the zap indicator for card "N" at step 628, then goes to step 608.

The handtype is one pair (step 620). The machine checks the number of zaps made so far. If the number of round zaps is greater than "Z" (step 626), it goes to step 632. ("Z" is a preset game parameter.) The purpose of step 626 is to lessen clutter and confusion on the display. This threshold test using "Z" insures that too many zap guiding symbols will not appear.

The machine goes to step 608 if the number of zaps is not greater than the "Z" variable. Otherwise, it sees if card "N" is part of a pair at step 632. If yes, it sees if there are any original cards. If any original cards are not part of pair (step 634), it goes to step 608. It is not necessary to decide whether to zap a pair card.

There are no original cards not part of the pair (step 634). The machine sees if the handtype is a winner (step 642). If the handtype is a winner, it goes to step 608. Otherwise, it sets the zap indicator for card "N" at step 640. Then it goes to step 608.

All the zap indicators set above cause the later display of the zap guiding symbols.

FLOW CHART FOR DISPLAYING GUIDING SYMBOLS—FIG. 7

Figure 7:
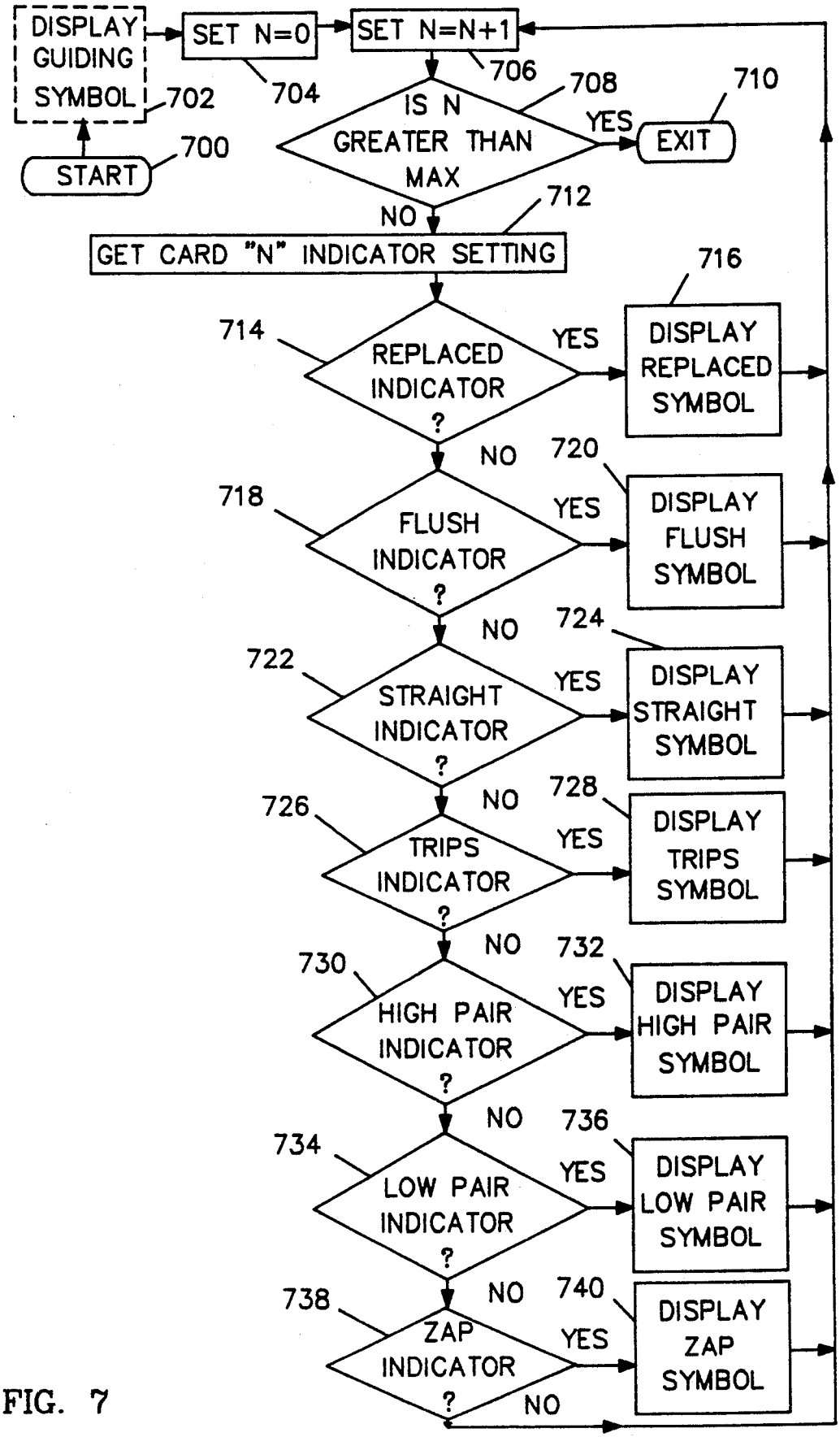
FIG. 7 is a flow chart showing the relative priorities of guiding symbols, and when to display each of them.

FIG. 7 is a flowchart showing when to display the guiding symbols.

The machine begins the process (step 700) of deciding when to display various guiding symbols (step 702).

In step 704 set "N" equal to zero. "N" stands for a number used to keep track of the card positions. In the preferred embodiment, there are five card positions displayed on the video screen. Within each card position is an original card or a replacement card. An original card is one of the cards initially displayed after the deal action starts a round. A replacement card is any card other than an original card.

In the preferred embodiment, one zaps each card position only one time per round. That is, the machine does not allow the zapping of a replacement card. For the preferred embodiment, a replaced guiding symbol appears above the replacement card immediately after the zap action.

In other embodiments, one zaps a card position more than once per round. For these alternative embodiments, the replaced guiding symbol appears above the card position after the final zap action for that card position.

The preferred embodiment has seven guiding symbols. There are guiding symbols for low pair, high pair and trips (three of a kind). Others are for straight chances and flush chances. Finally, there is one for suggesting a zap and one for the replaced symbols. The game design allows the addition of other guiding symbols.

Guiding symbols show directly above each card position. They show when a guiding symbol provides useful information for the card occupying a card position. There is the replaced guiding symbol discussed above. Guiding symbols highlight one pair cards, two pair cards and three of a kind (trips) cards.

Possible flush cards and possible straight cards show by exception only. The machine will not show cards making up a possible flush or a possible straight. It shows a flush guiding symbol for the one card to zap to try for a flush. It shows a straight guiding symbol above one card, or two cards of a pair, when appropriate. It indicates the card positions to zap to try for a straight.

It displays the zap guiding symbol to aid the player in making zap decisions. It does not display too many or they become worthless. It speeds play when the player can quickly spot obvious zap candidates. When one sees a zap guiding symbol, one safety zaps that card position with little concern. The card adds nothing to the hand.

At step 706, the machine sets "N" equal to "N"+1.

It sees if "N" is greater than the maximum number of displayed cards (step 708). If it is, it exits at step 710 since processing for all cards (five for preferred embodiment) is complete. Otherwise, it displays the proper guiding symbol for card "N" (step 712).

When card "N" has a replaced indicator set (step 714), the machine displays the replaced guiding symbol. In our game the replaced guiding symbol is a stop sign. The player cannot zap a replacement card with a replaced guiding symbol showing. The replaced guiding symbol appears after the player pushes the ZAP button. In the preferred embodiment, this occurs after zapping a card position one time. In other embodiments, this occurs after the final allowed zap for a card position. That is, some embodiments allow more than one zap per card position. Temporarily, a lightning bolt (zap strike display) also hits the associated card to confirm the player's zap action.

The machine sees if card "N" has a flush indicator set (step 718). If yes, it displays the flush guiding symbol on this card which is not part of a possible flush. We use an explanation point for a flush guiding symbol. When only one flush guiding symbol appears above a lone card, there is a strong chance for a flush. Thus, the player receives a clear hint this is the case. The machine goes to step 706.

At step 718, the machine sees if card "N" has a straight indicator set (step 722). If yes, it displays the straight guiding symbol (step 724) on the cards not part of a possible straight. Sometimes pair cards have both a pair indicator and a straight indicator set. The straight indicator usually has higher priority. If so, both cards of a pair have the straight guiding symbol displayed. The player must then choose which one of a pair to sacrifice to try for a straight. We use a question mark symbol for the straight guiding symbol. This clearly marks the cards which are not part of a possible straight. When a straight guiding symbol appears above a card, there is a good chance for a straight. The player clearly receives this hint. However, one must decide for oneself to try for a straight based on the rest of the hand. Now the machine goes to step 706.

The machine sees if card "N" has a trips (three of kind) indicator set (step 726). If yes, it displays the trips symbol (step 728) directly above each card part of the trips. We use a hand making an okay sign (thumb and index finger together in a circle) with three fingers extended for the trips guiding symbol. Then it goes to step 706.

The machine sees if card "N" has a high pair indicator set (step 730). If yes, it displays the high pair guiding symbol directly above each of the two high pair cards. It uses the same symbol as the low pair but with a different color. To show a pair, we use the pair guiding symbol of a hand extending two fingers. Other names used for this symbol are 'peace' and 'v for victory' sign.

The machine sees if card "N" has a low pair indicator set (step 734). If yes, it displays the low pair guiding symbol directly above each of the two low pair cards (step 736). It goes to step 706.

The machine sees if card "N" has a zap indicator set (step 738). If yes, it displays directly above card "N" the zap guiding symbol. We use a thumbs down display for the zap guiding symbol.

The machine repeats the above steps until the game ends.

After displaying guiding symbols at steps 716, 720, 724, 728, 732, 736, and 740, it goes to step 706. It repeats the loop for five cards.

FLOW CHART TO DETERMINE WHEN TO END ROUND—FIG. 8

Figure 8:
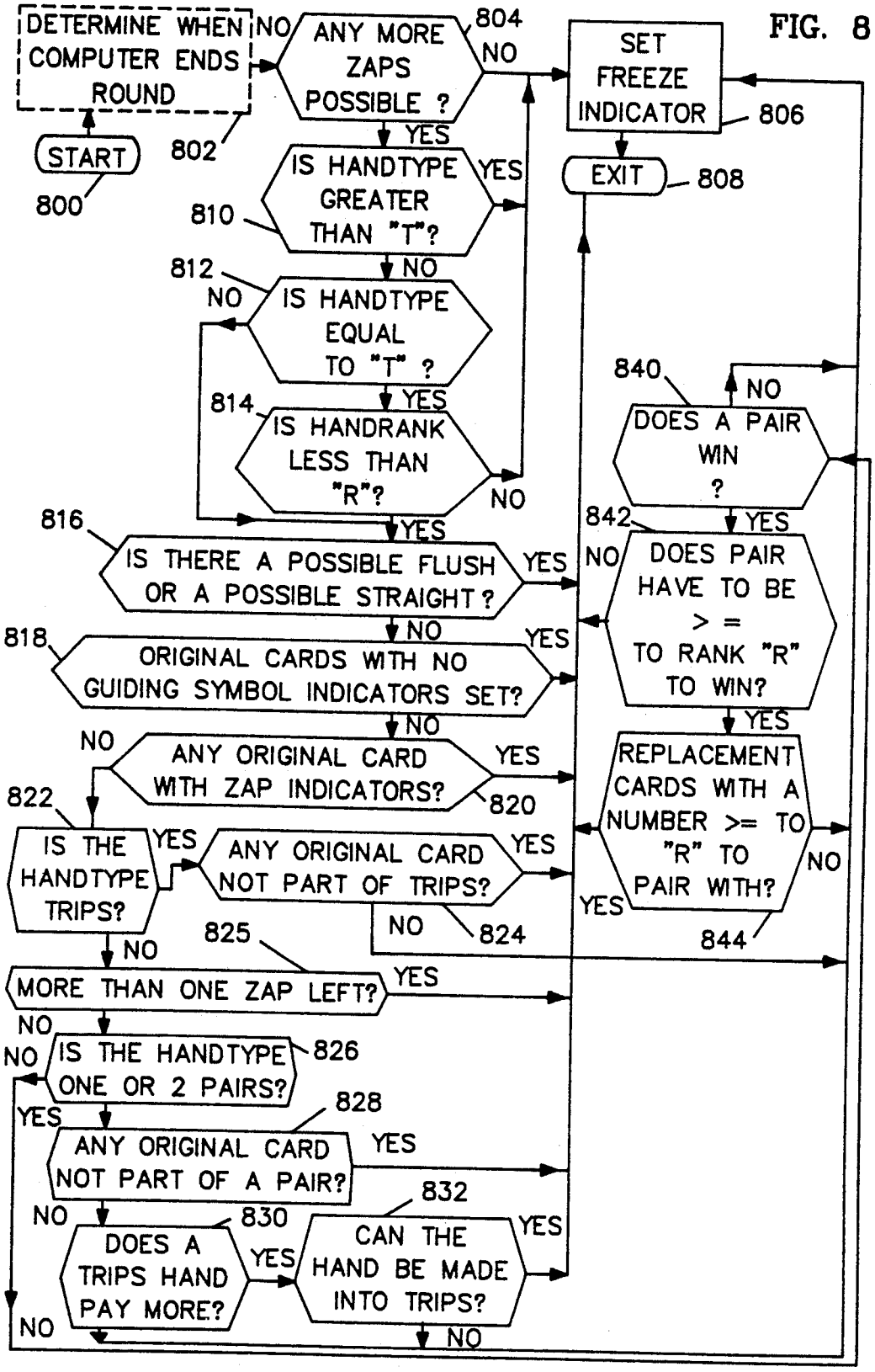
FIG. 8 is a flow chart to determine when the computer ends the round.

FIG. 8 is a flow chart to determine the various stages that the machine automatically ends the round. The round ends when the machine detects an instant win. The round also ends (instant end) when the hand cannot improve winnings through further zapping even through the player has another card or so to zap.

The machine starts the process at step 800 to determine when it will end the round (step 802).

The following discussion pertains to the preferred embodiment. The words "original cards" apply to the preferred embodiment. For other embodiments, substitute the word "card" in place of "original card". Other embodiments allow card positions to be zapped more than once. The preferred embodiment allows only one zap per card position.

If there are not any original cards left (step 804), the machine sets the freeze indicator (step 806). The round is over, it exits at 808. The automatic setting of the freeze indicator has the same effect as player depressing the FREEZE button.

Some handtype and handrank values are instant wins. Two threshold checks made against variables "T" and "R" determine instant wins. The "T" variable, with a range zero (high card) to ten (five of kind), tests handtype. The "R" variable, with a range one (low ace) to fourteen (high ace), tests handrank. The hand is an instant win if the handtype is higher than "T" (step 810). A handtype equal to the "T" variable is an instant win if the handrank is not less than "R" (step 814). If the hand is an instant winner, the machine sets the freeze indicator (step 806) and ends the round (step 808). Otherwise, if the hand is not an instant win based on handtype and handrank, it goes to step 816.

If the handrank is equal to "T" (step 812), the machine sees if the handrank is less than "R" (step 814). "R" stands for handrank which is the relevant high card for the handtype. A flush is an example of a handtype. In describing jack high flush, the handrank is a jack. A handtype with two pairs, kings and sevens, has a handrank of a king. The handtype and the handrank are incorporated into a hand value. The hand value lets one hand be better than another hand although both have the same handtype. Say several hands have the same "T" handtype. In this instance, A handrank of "R" or greater is an instant win. A handrank of less than "R" is not. If the handtype is equal to "T" and the handrank is not less than "R" (step 814), the hand is an instant winner. The machine sets the freeze indicator.

If the handtype is less than the "T" variable (step 812), the machine goes to step 816. If the handtype is equal to "T" and the handrank is less than the "R" variable, it goes to step 816. Otherwise, it sees if the hand has a chance of making a handtype of a straight or a flush. Already, the hand might be a winner and the player could claim winnings with a freeze action. However, the chance of a straight or flush could improve the winnings with one or more zaps. When there is a straight or a flush chance, it will not end the round with an instant end.

Now, the machine looks for a possible straight and a possible flush (step 816). If found, the hand winnings can still improve. It exits (step 808) to let the player decide whether to zap or to freeze.

When there is no flush or straight chance (step 816), the machine finds an original card with no guiding symbol indicator set (step 818). If any found, there is an original card without the zap indicator set, that is, not zapped earlier. If found, it exits (step 808) since the player can zap another card. The round is not yet over.

Now, the machine sees if the card has a zap indicator set (step 820). The zap guiding symbols are displayed on the cards with the zap indicators set. The player should zap that card since it adds nothing to the hand. Therefore, it exits (step 808) since the round is not over.

Next, the machine sees if the hand has a handtype of trips (step 822). If yes, it finds any cards with no trips indicator set (step 824). If any found, it exits (step 808) since the player should zap these cards to improve the hand. Otherwise, it freezes the hand (step 806). It declares the winnings and ends the round. This is an instant end. The hand could improve if the player breaks up a winning hand. To speed play, the machine gives winnings to the player and closes out the game.

In step 822 if the handtype was not trips, the machine sees if there is more than one zap left (step 825). If there is, it exits. If not, it sees if the hand has a handtype of one or two pairs (step 826). If yes, it finds an original card not part of a pair (step 828). If found, it exits (step 808) since the player should zap any card not helping the hand. Otherwise, the original card is a pair card.

In step 826 if there is no pair in the hand, it goes to step 840.

The machine sees if a trips handtype (step 830) pays more winnings than a handtype of two pairs. If yes, and the hand could improve through trips (step 832), it exits (808) to let the player try for trips. If a trips handtype does not pay more, it sets the freeze indicator (step 806), declares winnings, and ends the round. This is an instant end.

Next, the machine sees if the handtype is one pair (step 836). If yes, it sees if a handtype of trips pays more than a handtype of one pair (step 830). If yes, it exits (step 806) to let player try for trips. Otherwise, it finds an original card not part of a pair. If not found, it sets the freeze indicator (step 806), declares the winnings, and ends the round for an instant end. Otherwise, it exits (step 808) so the player can try for trips by zapping the original card.

If the hand has a handtype less than a pair, and if a pair does not pay winnings (step 840), the machine sets the freeze indicator (step 806) for an instant end. Even if hand improves to a pair, it still will not be a winner. Then it ends the round. If a pair can win, it sees if pair handrank (step 842) must pass the "R" variable threshold test to win. In this case, "R" is a handrank threshold test for a pair. Can any pair win or does pair have to be, for example, a pair of jacks or higher? If there are no restrictions, it exits at step 808, since the next zap can produce a pair of any handrank and win. Otherwise the pair handrank must meet the "R" variable threshold. It sees if a replacement card with a number greater than or equal to "R" (step 844) exists. A high replacement card which can be paired with meets the "R" threshold test. If yes, it exits (step 808). Let the player try to pair with the replacement card numbered "R" or greater. If no high replacement cards exist, the machine sets the freeze indicator (step 806) and ends the round for an instant end.

Now, testing for all instant win and instant end conditions is complete. Play ended when winnings could not improve or when the hand could never improve into a winning hand (instant end). Passing threshold tests "T" and "R" caused an instant win condition, and of course ended the round. If there is no hope of improving the hand and the hand is a winner, an instant end occurs.

Predetermined instant wins occur for certain handtypes. The machine may declare an instant win even though the hand could improve. An instant win feature prevents the player from improving the winnings. However, if the "T" threshold is high enough, say at the straight level, it is an acceptable tradeoff. Instant wins speed play considerably.

The royal flush is the highest handtype (with no wild cards) and an instant win. A "T" threshold level of a straight produces instant wins for handtypes of a straight through a royal flush. With a joker or wild card, another instant win is five of a kind.

There may be a trips hand and no original non-trips cards, that is, all original cards are part of trips. A player deciding whether to keep this trips hand or go for a full house would slow play. For this reason, the machine declares an instant end for the handtype trips when all original cards are part of trips except when there is a chance at a straight or a flush. It is unlikely a player would break up the trips for a chance at a straight or a flush. However, let the player have a chance anyway. If during game development, it is decided that play must be speeded more, the above straight and flush test can be dropped. That is, when a trips hand has no original non-trips cards, the machine declares an instant end. Game design allows the dropping of the straight and flush test.

In some instances, a trips hand could improve (with luck) to a full house. This would occur infrequently, and besides the player must break up a winning trips hand. Therefore, it declares an instant end for handtype trips when no straight or flush chance exists.

Hands of one pair and two pairs are instant wins when winnings cannot improve through more zaps.

OPERATING THE ONE-AT-A-TIME ZAP POKER VIDEO GAME—FIG. 1

The following gives an operating perspective of our one-at-a-time zap poker video game. It is from the player's viewpoint while operating the machine of FIG. 1.

The machine is already on line waiting for the player to play. An "INSERT COIN" message flashes on the video screen until a player inserts a coin into inlet 54. Each coin entered adds to a displayed coin total. Then a "PLEASE BET" message appears on screen 50. The player pushes BET button 56 to set the amount of the bet size desired. With enough credits, the machine automatically advances the bet size amount each round. This bet size amount stays unchanged unless the player changes it, or there are not enough credits for the bet size. This automatic bet advancement continues as long as there are enough credits (FIG. 4).

In all variations of the draw poker game (not our zap poker game), the player selects all cards to keep before discarding the other cards. The discarded cards are all discarded simultaneously. It is a one-shot draw. Our new game allows the player to zap their cards one-at-a-time which leads to unexpected results.

The machine will deal and display maximum cards (five for preferred embodiment) when the player pushes DEAL button 58. A "ZAP OR FREEZE" message follows. If appropriate, guiding symbols will appear above the cards to guide the player through the game. A thumbs-down symbol (zap guiding symbol) may appear above a card for a strong sign to the player to zap that particular card. A pairs symbol (hand with two extended fingers) may advise caution in zapping a card since it is one of a pair.

The player pushes ZAP button 62 directly below the selected card. There is a ZAP button centered under each one of the displayed cards. A temporary lightning bolt (zap strike symbol) hits the selected card. The old card disappears from the screen. A new randomly selected card immediately replaces the previous card.

A stop sign (the replaced guiding symbol) shows directly above the new card. It tells the player that the card is a replacement card. The stop sign clearly shows that no further actions are possible for that card position. This is the preferred embodiment. (Other embodiments allow multiple zaps for a card position. Then the stop sign appears only after the final zap allowed for the card position.)

A winning hand causes a "FREEZE TO WIN 1" (or 2, 3, or any other amount) message to flash on the screen. The player may take the win by pushing FREEZE button 60. Conversely, the player can play for a better winning hand before accepting the credits. The player could lose the winnings already won with unlucky zaps in later play.

The summary hand information (FIG. 4) display tells the player the type of hand held. The player may have earlier kept a high card to try for a royal flush, but the royal flush chance vanished after the previous zap. Now, say an explanation point (flush guiding symbol) appears above the high card. It hints that a flush is possible if the player would zap that high card. One zaps this high card (with a flush guiding symbol) for a flush chance if one feels lucky. The player takes the guiding symbol displays into account before zapping the next card. The player continues to push ZAP button 62 for the maximum number of allowed zaps, or the player pushes FREEZE button 60 to end the round.

A round is instantly ended in some circumstances before five cards are zapped. Certain winning card combinations cause an instant win. An instant win declares automatically without input from the player. Also an instant end occurs when the hand winnings cannot improve. This speeds the play of the game. Play ends with any winnings declared by a display on the monitor.

Next, if the player did not win, a "GAME OVER" message appears. A "YOU WIN XX" message (where XX is the amount of the win) appears when the player wins. A win causes winnings to add to credits, and associated displays are updated.

REPLAY button 64 is used to settle disputes between the player and casino management. Button 64 causes an exact replay of the entire game from beginning to end to show what events happened.

If the player wants to collect the credits (retained winnings), he or she pushes COLLECT button 66. Coins release into outlet 68 for the player to pickup by hand. If the player has zapped all allowed cards without winning anything as determined by the posted pay schedule, the "GAME OVER" message appears.

The game is over. If the player has enough credits to play again, a "PLEASE BET" message prompts the player. If not, the "INSERT COIN" message appears.

SUMMARY, RAMIFICATIONS, AND SCOPE

The gambling industry has tried many possible variations of video draw poker, but not the "one-at-a-time" method of play. With this feature, the player enjoys the game more. Also the player can see the results of the last zap before making the next zap. This eliminates rote playing, giving the player the challenge of making lesser winning hands after trying for the royal flush.

The following unique features apply to our "one-at-a-time" zap poker video game. We have an instant win before the maximum number of zaps. We have helpful guiding symbols to speed play. We cause instant end of play for a hopeless hand. We have a unique method of removing and replacing cards one-at-a-time. These features improve draw poker video play.

While our above description contains many specificities, these should not be construed as limitations on the scope of the invention, but rather as an exemplification of preferred embodiments thereof. Accordingly, the scope of the invention should be determined not by the embodiments illustrated, but by the appended claims and their equivalents.

We claim:

1. A machine for enabling a player to play a card gambling game with displayed cards and enable said player to remove and replace cards one at a time, comprising:

(a) card display means for displaying a plurality of cards in a player's hand;

(b) money display means for displaying a bet, credits, and winnings;

(c) bet means for enabling said player to bet, and said money display means being arranged to display said bet;

(d) deal means for simulating a deal to said player of a hand of said cards after said bet, and for causing said card display means to display said cards;

(e) zap means for simulating the removing of a card from said player's hand and randomly replacing said card with a replacement card, and for causing said card display means to display said card hand with said replacement card, and then providing a replaced-card indicator adjacent said replacement card;

(f) zap control means for determining if a predetermined condition is met, that said card in said player's hand is eligible to have said zap means operate on said card and for allowing said zap means to operate on said card;

(g) freeze means for setting a freeze indicator to indicate the end of a round;

(h) final means for determining that said round is over and operating said freeze means;

(i) key means for interpreting actions by said player and operating said bet means for a bet action, said deal means for a deal action, said zap control means for a zap action, and said freeze means for a freeze action;

(j) indicator means for setting a plurality of guiding symbol indicators for said card and for displaying a corresponding plurality of guiding symbols for said guiding symbol indicators;

(k) winnings means for calculating said winnings for said player based on value of said player's hand, and for operating said money display means to show said winnings if said round has ended;

(l) end means for operating said final means, then detecting the setting of said freeze indicator and operating said winnings means to display said final winnings and ending said round by paying said winnings as credits to said player; and (m) means for repeatedly activating said means of clauses (i) through (l) until said end means determines that said round is complete.

2. The card gambling machine of claim 1, further comprising:

deal number means for counting number of dealt said cards, and for allowing five, and only five, cards to be dealt to said player's hand;

whereby the one-at-a-time zap poker game shows five cards in the display.

3. The card gambling machine of claim 1, further comprising:

zap strike means for determining said zap means is operating for said card position, then temporarily showing a zap strike symbol for said card position;

whereby the effect of a lightning bolt hitting a card is very graphic and entertaining.

4. The card gambling machine of claim 1, further comprising:

(a) zap position means for determining a card position in said player hand and for bumping a card position count for said card position each time said zap means operates on said card position;

(b) maximum position means for determining said card position count exceeds a maximum position count and stopping the operating of said zap means on said card position;

5. The card gambling machine of claim 4, further comprising:

(a) bet position means for determining said card position is eligible for operating said zap means on said card position if said player takes said bet action;

(b) position allow means for operating said bet means and after said bet is a certain size, operating said zap means on said card position;

whereby said game allows another zap action when maximum number of zap actions have been taken for the card position if the player pays with a bet.

6. The card gambling machine of claim 4, further comprising:

(a) zero position means for determining if said card position count exceeds a count of zero for said card position, and preventing the operating of said zap means on said card position until said player takes said bet action;

(b) zero counter means for bumping a position zero counter for said card position each time said zap means operates on said card position;

(c) maximum zero means for determining that said position zero counter will exceed a maximum zero number, and disallowing said zap action by said player on said card position;

(d) zero control means for operating said zero position means, said zero counter means, and said maximum zero means;

(e) zero bet means for operating said zero control means and if said position zero counter will not exceed said maximum zero number, then operating said bet means to accept said bet for said card position, then operating said zap means on said card position, then setting said card position count to zero;

whereby a bet lets player take a zap action for one card position.

7. The card gambling machine of claim 4, further comprising:

(a) all-zero position means for determining said card position count will exceed a count of zero for said card position, and preventing the operating of said zap means on said card position until said player takes said bet action;

(b) all-zero counter means for bumping a position all-zero counter for said card position each time said zap means operates on said card position;

(c) maximum all-zero means for determining that said position all-zero counter will exceed a maximum all-zero number, and disallowing said zap action by said player on said card position;

(d) all-zero control means for operating said all-zero position means, said all-zero counter means and said maximum all-zero means;

(e) all-zero means for operating said all-zero control means and if said position all-zero counter will not exceed said maximum all-zero number, then operating said bet means to accept said bet for said card position, then operating said zap means on said card position, then setting every card position count to zero;

whereby a bet lets player take one zap action for each card position.

8. The card gambling machine of claim 4, further comprising: position alternate means for preventing said player of using said zap means sequentially for same card position;

whereby the same card position cannot be zapped twice in a row.

9. The card gambling machine of claim 4, further comprising:

one position means for determining if said card position count exceeds a count of one for said card position, and disallowing the operating of said zap means;

whereby each card position can be zapped only once.

10. The card gambling machine of claim 1, further comprising:

(a) instant win means for determining if said card hand meets an instant win threshold test and then operating said freeze means;

(b) instant end means for determining if said card hand meets requirements for an instant end and then operating said freeze means;

(c) maximum zap means for determining if said zap means has operated a maximum number of zaps and then operating said freeze means;

(d) means for operating instant win means, instant end means, and maximum zap means;

whereby said game can be ended automatically by an instant win, an instant end, or when the number of zapped cards exceeds a predetermined number.

11. The card gambling machine of claim 10, further comprising:

maximum number means for bumping a total zap counter and when said total zap counter exceeds said maximum number of zaps, preventing the operating of said zap means, and then setting said freeze indicator;

whereby the number of cards to be zapped is limited.

12. The card gambling machine of claim 11, further comprising:

five number means for determining if the count in said total zap counter exceeds five, and preventing operation of said zap means and then setting said freeze indicator;

whereby the total number of zap actions allowed per round is five.

13. The card gambling machine of claim 1, further comprising:

(a) indicator means for determining whether the cards in said player's hand comprise a low pair, a high pair, or three-of-a-kind, and then associating said card with one of a plurality of group indicators including a low pair indicator, a high pair indicator, and a three-of-a-kind indicator;

(b) straight indicator means for determining which of said cards in said player's hand might cause a straight hand if said zap means operated on said card, and then associating said card with a straight indicator;

(c) flush indicator means for determining which card in said player's hand might cause a flush hand if said zap means operated on said card, and then associating said card with a flush indicator;

(d) zap indicator means for determining which card in said player's hand might safely have said zap means operate on said card without decreasing winnings, and then associating said card with a zap indicator;

(e) guiding symbol means for selecting the highest priority indicator for said card and displaying a guiding symbol from the group consisting of a replaced symbol, a flush symbol, a straight symbol, a three-of-a-kind symbol, a high pair symbol, a low pair symbol, and a zap symbol;

whereby a player sees graphic symbols above each displayed card telling when to keep or zap a card.

14. The card gambling machine of claim 1 wherein said machine comprises:

(a) a cabinet structure defining a player station;

(b) a monitor located within said cabinet structure, said monitor having a display screen viewable from said player's station;

(c) a microprocessor including a memory for storing a set of playing rules and parameters, located in said cabinet structure, and electrically connected to said monitor and said central processing unit;

(d) an instruction activator input device including a keyboard connected to an input means, and being accessible from said player's station to enable said player to supply game and wagering data into said central processing unit; and (e) means for providing a display of visual representations of said game symbols and causing the display of said visual representations on said display device, including a display of said cards, input coins, said bet, said winnings, said credits, conditions of said game, and visual indicators for said instruction activators.

15. A machine for enabling a player to play a card gambling game with five displayed cards providing for said player to remove and replace a card one at a time, comprising:

(a) card display means for displaying five cards in a player's hand;

(b) money display means for displaying a bet, credits, and winnings;

(c) bet means for enabling said player to bet, and said money display means being arranged to display said bet;

(d) deal means for simulating a deal to said player of five cards after said bet, and for causing said card display means to display said five cards;

(e) zap means for simulating the removing of a card from said player's hand and randomly replacing said card with a replacement card, and for causing said card display means to display said card hand with said replacement card and for temporarily showing a zap strike symbol for said replacement card, and then providing a replaced-card indicator adjacent said replacement;

(f) zap control means for determining if a predetermined condition is met that said card in said player's hand is eligible to have said zap means operate on said card, and for allowing said zap means to operate on said card;

(g) freeze means for setting a freeze indicator to indicate the end of a round;

(h) final means for determining that said round is over and operating said freeze means;

(i) key means for interpreting actions by said player and operating said bet means for a bet action, said deal means for a deal action, said zap control means for a zap action, and said freeze means for a freeze action;

(j) indicator means for setting a plurality of guiding symbol indicators for said card and for displaying a corresponding plurality of guiding symbols for said guiding symbol indicators;

(k) winnings means for calculating said winnings for said player based on value of said player's hand, and for operating said money display means to show said winnings if said round has ended;

(l) end means for operating said final means, then detecting the setting of said freeze indicator and operating said winnings means to display said winnings and ending said round by paying said winnings to said player as credits or money; and (m) means for repeatedly activating said means of clauses (i) through (l) until said end means determines that said round is complete.

16. The card gambling machine of claim 15, further comprising:

(a) zap position means for determining a card position in said player's hand and for bumping a card position count for said card position each time said zap means operates on said card position;

(b) maximum position means for determining said card position count exceeds a count of one and stopping the operating of said zap means on said card position;

whereby each card position can be zapped a maximum of one time.

17. The card gambling machine of claim 15, further comprising:

(a) instant win means for determining if said card hand meets an instant win threshold test and then operating said freeze means;

(b) instant end means for determining if said card hand meets requirements for an instant end and then operating said freeze means;

(c) maximum zap means for determining if said zap means has operated five times successfully and then operating said freeze means;

(d) means for operating instant win means, instant end means, and maximum zap means;

whereby the total number of zap actions per round cannot exceed five.

18. The card gambling machine of claim 15, further comprising:

(a) indicator means for determining whether the cards in said player's hand comprise a low pair, a high pair, or three-of-a-kind, and then associating said card with one of a plurality of group indicators including a low pair indicator, a high pair indicator, and a three-of-a-kind indicator;

(b) straight indicator means for determining which of said cards in said player's hand might cause a straight hand if said zap means operated on said card, and then associating said card with a straight indicator;

(c) flush indicator means for determining which said card in said player's hand might cause a flush hand if said zap means operated on said card, and then associating said card with a flush indicator;

(d) zap indicator means for determining which said card in said player's hand might safely have said zap means operate on said card without decreasing winnings, and then associating said card with a zap indicator; and (e) guiding symbol means for selecting the highest priority indicator for said card and displaying a guiding symbol from the group consisting of a replaced symbol, a flush symbol, a straight symbol, a three-of-a-kind symbol, a high pair symbol, a low pair symbol, and a zap symbol.

19. A machine for enabling a player to play a card gambling game with five displayed cards providing for player to remove and replace a card one at a time, comprising:

(a) card display means for displaying five cards in a player's hand;

(b) money display means for displaying a bet, credits, and winnings;

(c) bet means for enabling a player to bet, and said money display means being arranged to display said bet;

(d) deal means for simulating a deal to said player of a hand of five original cards after said bet, and for causing said card display means to display said five original cards;

(e) zap means for simulating the removing of an original card from said player's hand and randomly replacing said original card with a replacement card, and for causing said card display means to display said card hand with said replacement card in place of said original card;

(f) zap control means for determining if a predetermined condition is met that said zap means has not operated on said original card in said player hand, then operating said zap means on said original card;

(g) freeze means for setting a freeze indicator to indicate the end of a round;

(h) last zap means for determining said zap means has operated successfully on said five original cards, then operating said freeze means;

(i) key means for interpreting actions by said player and operating said bet means for a bet action, said deal means for a deal action, said zap control means for a zap action, and said freeze means for a freeze action;

(j) winnings means for calculating said winnings for said player based on value of said player's hand, and for operating said money display means to show said winnings if said round has ended;

(k) end means for operating said last zap means, then detecting the setting of said freeze indicator and operating said winnings means to display said final winnings and ending said round by paying said winnings as credits to said player; and (l) means for repeatedly activating said means of clauses (h) through (l) until said end means determines that said round is complete.

* * * * *